US006526252B1

(12) United States Patent
Itoh et al.

(10) Patent No.: US 6,526,252 B1
(45) Date of Patent: Feb. 25, 2003

(54) APPARATUS AND METHOD FOR FORMING IMAGE

(75) Inventors: Shinichi Itoh, Yokohama (JP); Tetsuo Katoh, Kunitachi (JP); Tatsuyuki Miura, Yokohama (JP); Seiji Tsuzuki, Kawaguchi (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/975,976

(22) Filed: Oct. 15, 2001

(51) Int. Cl.[7] ..... G03G 21/10; G03G 15/08
(52) U.S. Cl. ..... 399/359; 399/30; 399/61
(58) Field of Search ..... 399/359, 358, 399/27, 30, 58, 61, 258, 259

(56) References Cited

U.S. PATENT DOCUMENTS 5,737,680 A * 4/1998 Takagaki et al. ..... 399/359
6,192,212 B1 * 2/2001 Kunihiro et al. ..... 399/359
6,226,490 B1 * 5/2001 Fujita et al. ..... 399/359

FOREIGN PATENT DOCUMENTS

JP 2000-131946 * 5/2000
JP 2000-267366 9/2000

* cited by examiner

*Primary Examiner*—Sophia S. Chen
(74) *Attorney, Agent, or Firm*—Foley & Lardner

(57) ABSTRACT

An image forming apparatus and method cause a connecting/conveying device to convey a recovered toner from a cleaner part to a recovered toner housing to house therein the recovered toner, and cause a controller to control a recovered toner supply and a new toner supply in accordance with a toner concentration ratio in a developing device, which is detected by a toner concentration ratio detector, to supply the recovered toner, which is stored in the recovered toner housing, and the new toner, which is stored in the new toner housing, to the developing device. The controller separately controls the recovered toner supply and the new toner supply in accordance with the contents detected by the toner concentration ratio detecting means, to cause to change the combination of the amounts of the recovered toner and new toner to be supplied to the developing device.

4 Claims, 11 Drawing Sheets

APPARATUS AND METHOD FOR FORMING IMAGE

TECHNICAL BACKGROUND

The present invention generally relates to an apparatus and method for forming an image, and is capable of being applied to an image forming apparatus and method, which utilize toner of a copying machine or printer having a photosensitive drum.

In an image forming apparatus and method utilizing toner, there is carried out an image forming process for electrifying minus charges on the surface of a photosensitive drum, exposing (varying the surface potential of) the photosensitive drum to laser beams based on picture signals to form a latent image, causing it to absorb minus charged toner to form a visible image, and transferring and fixing the visible image on a paper.

In such image formation, a toner (which will be hereinafter referred to as a "recovered toner") which has been already utilized in image formation, and a toner (which will be hereinafter referred to as a "new toner") which has not yet been utilized in image formation, are mixed to be utilized. That is, the recovered toner is recycled to be used.

Conventionally, as a method for recycling a recovered toner, there is a method for conveying a recovered toner, which leaves a cleaner auger, to a developing device by means of a connecting auger, which connects the cleaner auger to the developing device, and returning the recovered toner directly into the developing device.

In the conventional method, in view of the ratio of a new toner to the recovered toner in the developing device, both of the new toner and the recovered toner are supplied if the supply of toner is required.

For example, when the amount of toner in the developing device is very small, the operation mode is changed to a forced supply mode to force to supply both of the new toner and the recovered toner.

However, an external additive is peeled from the recovered toner, and paper powder is mixed in the recovered toner. Therefore, even if the recovered toner is supplied into the developing device, the rise of the quantity of electrification is worse than that in the case of the new toner. For that reason, in some circumstances, the presence of the recovered toner causes image fogging on an image transferred on a paper.

SUMMARY OF THE INVENTION

It is an object of the present invention to prevent the bad influence of the conventional parallel supply of a new toner and a recovered toner into a developing device.

In order to accomplish the aforementioned object, according to the present invention, an image forming apparatus comprises: recovered toner housing means for temporarily storing therein a recovered toner; a connecting/conveying device for conveying the recovered toner from a cleaner part to the recovered toner housing means; recovered toner supply means for supplying the recovered toner, which is housed in the recovered toner housing means, to a developing device; new toner housing means for housing therein a new toner; new toner supply means for supplying the new toner, which is stored in the new toner housing means, to the developing means; toner concentration ratio detecting means for detecting a toner concentration ratio in the developing device; and control means for separately controlling the recovered toner supply means and the new toner supply means in accordance with the contents detected by the toner concentration ratio detecting means, to cause to change the combination of the amounts of the recovered toner and new toner to be supplied to the developing device.

In order to accomplish the aforementioned object, according to the present invention, there is provided an image forming method for causing a connecting/conveying device to convey a recovered toner from a cleaner part to recovered toner housing means to house therein the recovered toner, and causing control means to control recovered toner supply means and new toner supply means in accordance with a toner concentration ratio in a developing device, which is detected by toner concentration ratio detecting means, to supply the recovered toner, which is stored in the recovered toner housing means, and a new toner, which is stored in new toner housing means, to the developing device, wherein the control means separately controls the recovered toner supply means and the new toner supply means in accordance with the contents detected by the toner concentration ratio detecting means, to cause to change the combination of the amounts of the recovered toner and new toner to be supplied to the developing device.

BEST MODE FOR CARRYING OUT THE INVENTION

The preferred embodiment of an image forming apparatus and method utilizing toner according to the present invention will be described below. In the following description, it is assumed that a copying machine is provided with a preferred embodiment of an image forming apparatus according to the present invention.

The image forming apparatus is incorporated in a copying machine for forming and transferring an image on a paper by the reversal development system on the basis of the original to be copied.

Figure 1:
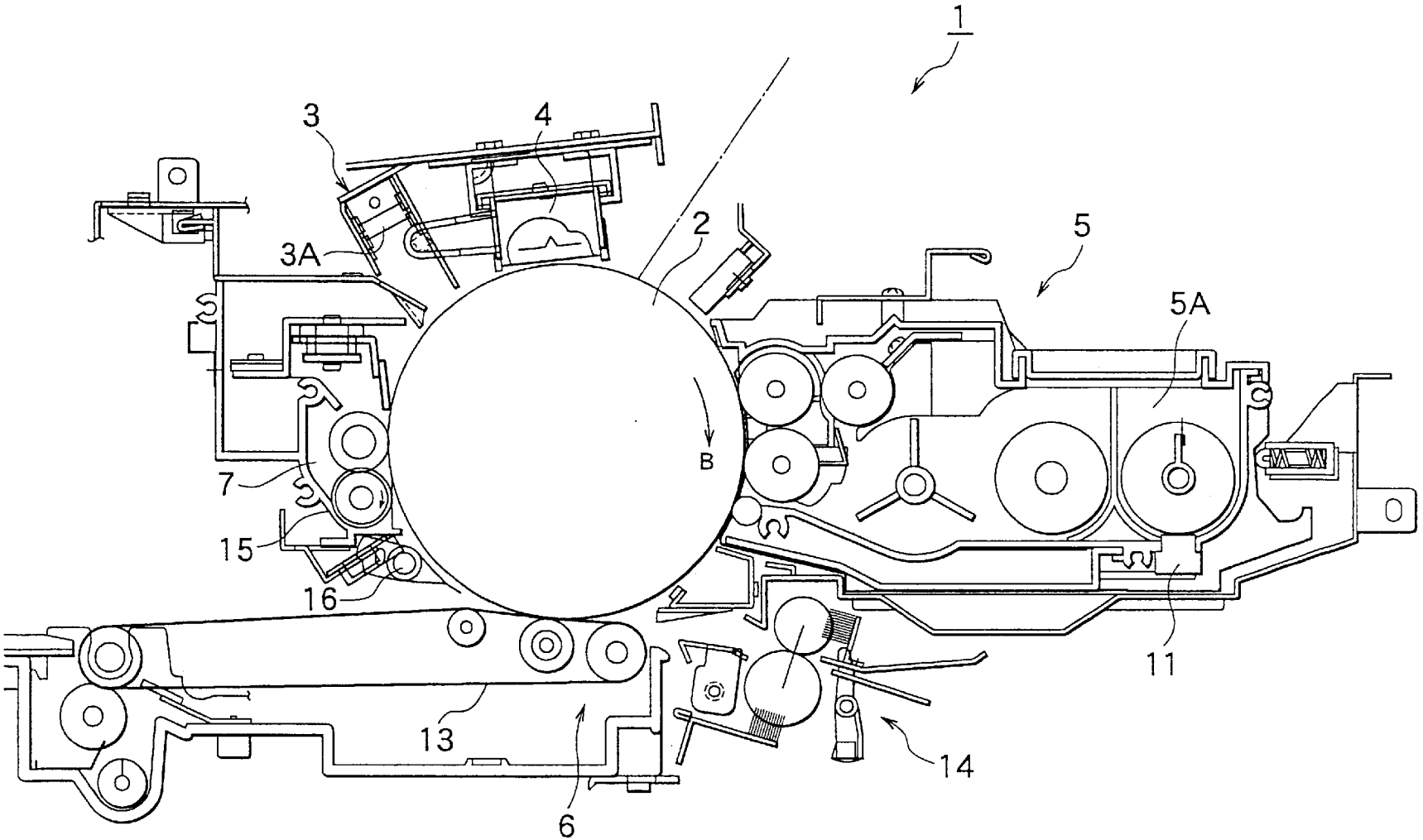
FIG. 1 is a schematic front view showing a principal part of a preferred embodiment of an image forming apparatus according to the present invention.
Figure 2:
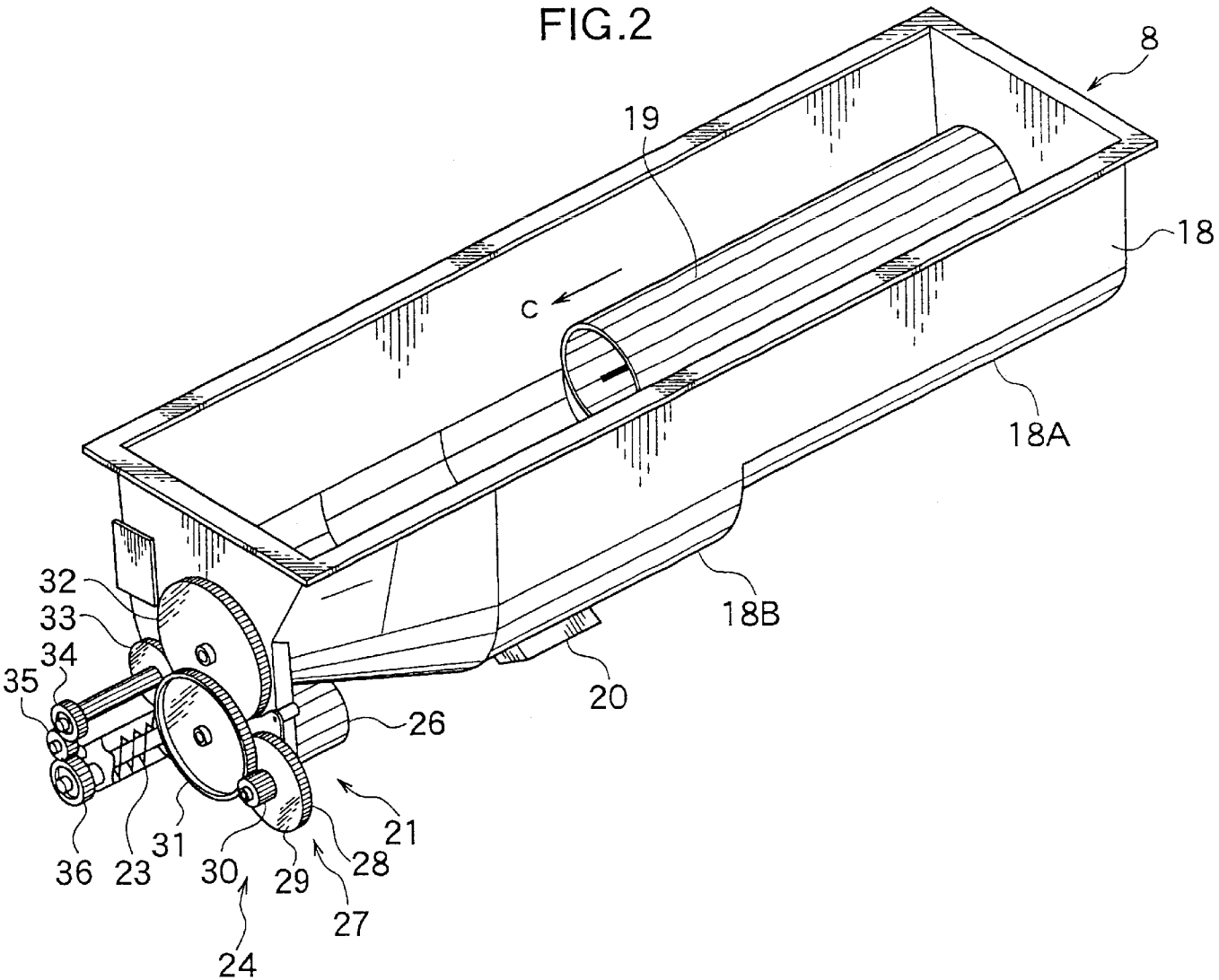
FIG. 2 is a perspective view of a preferred embodiment of a new toner supply device according to the present invention.
Figure 3:
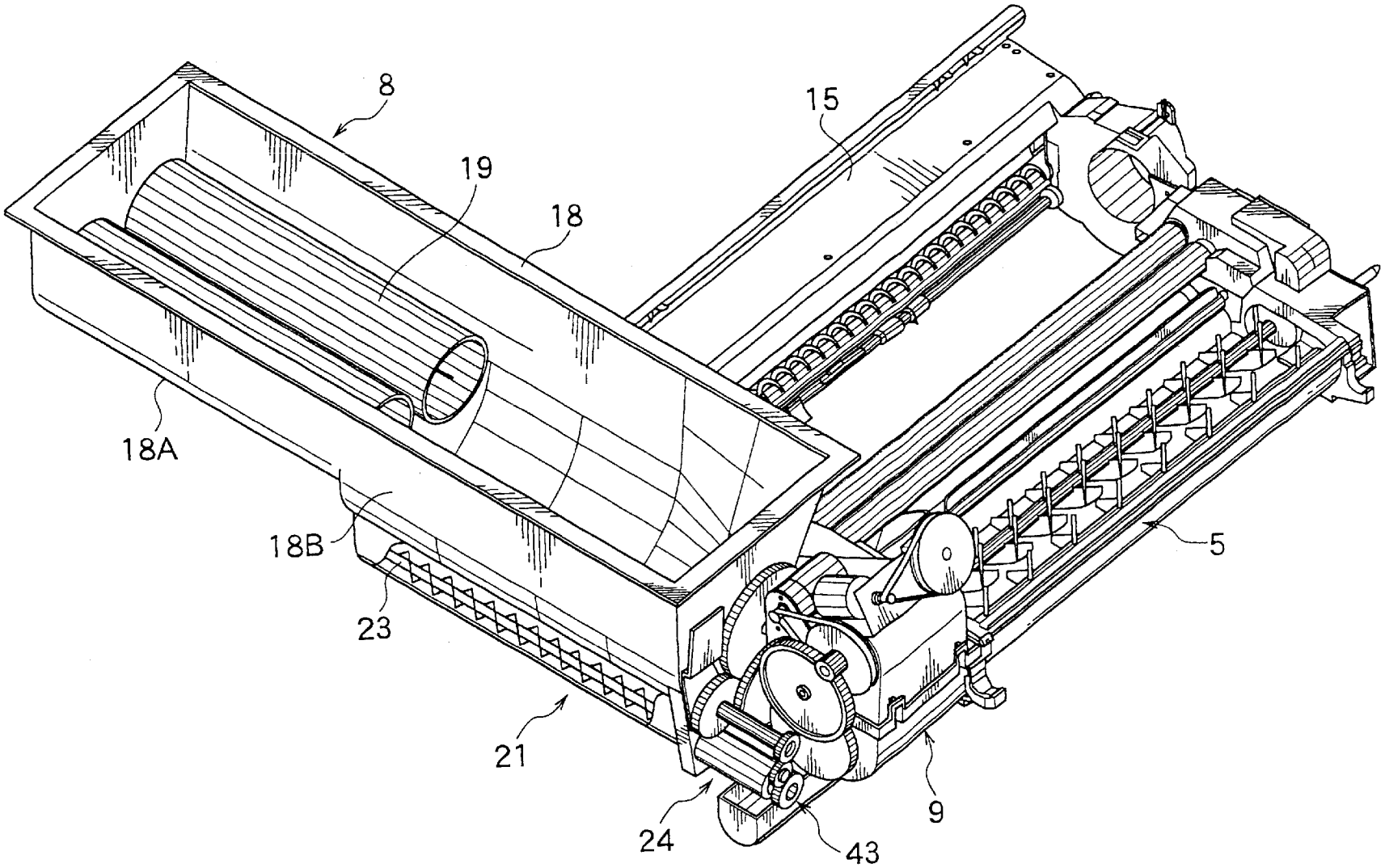
FIG. 3 is a perspective view of the image forming apparatus in the preferred embodiment.
Figure 4:
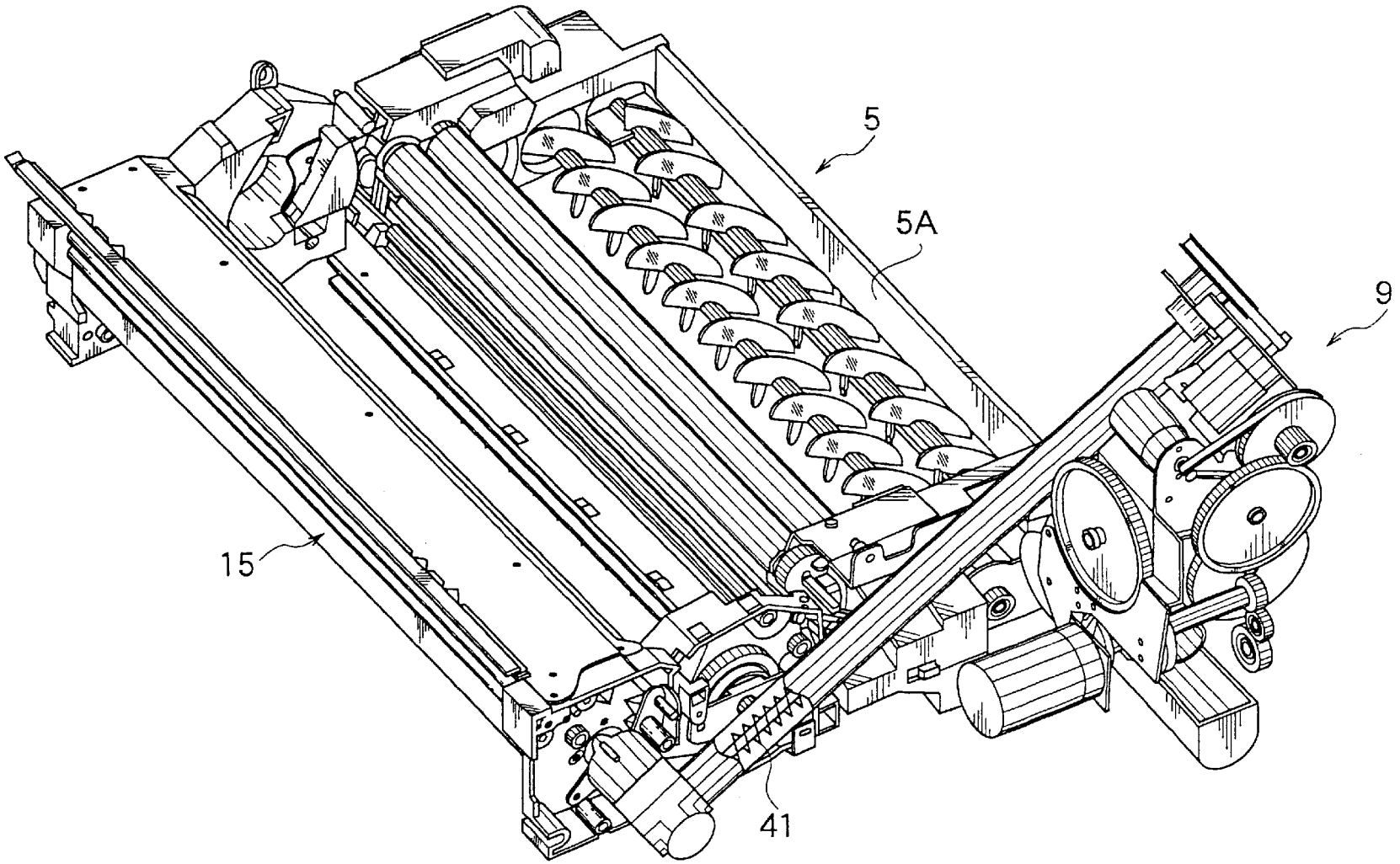
FIG. 4 is a perspective view of the image forming apparatus in the preferred embodiment, from which the new toner supply device is removed.
Figure 5:
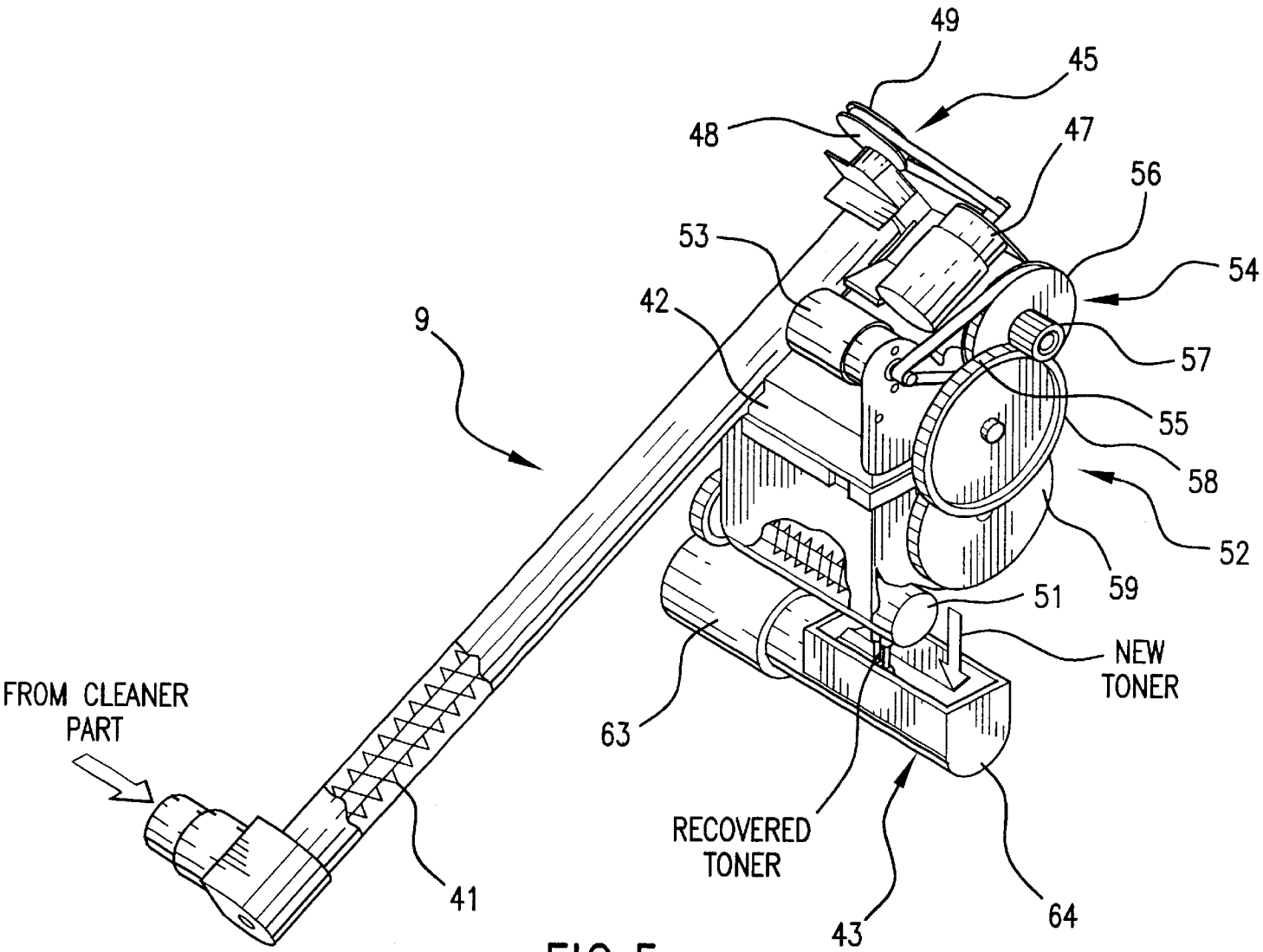
FIG. 5 is a perspective view of a preferred embodiment of a recovered toner supply device according to the present invention.
Figure 6:
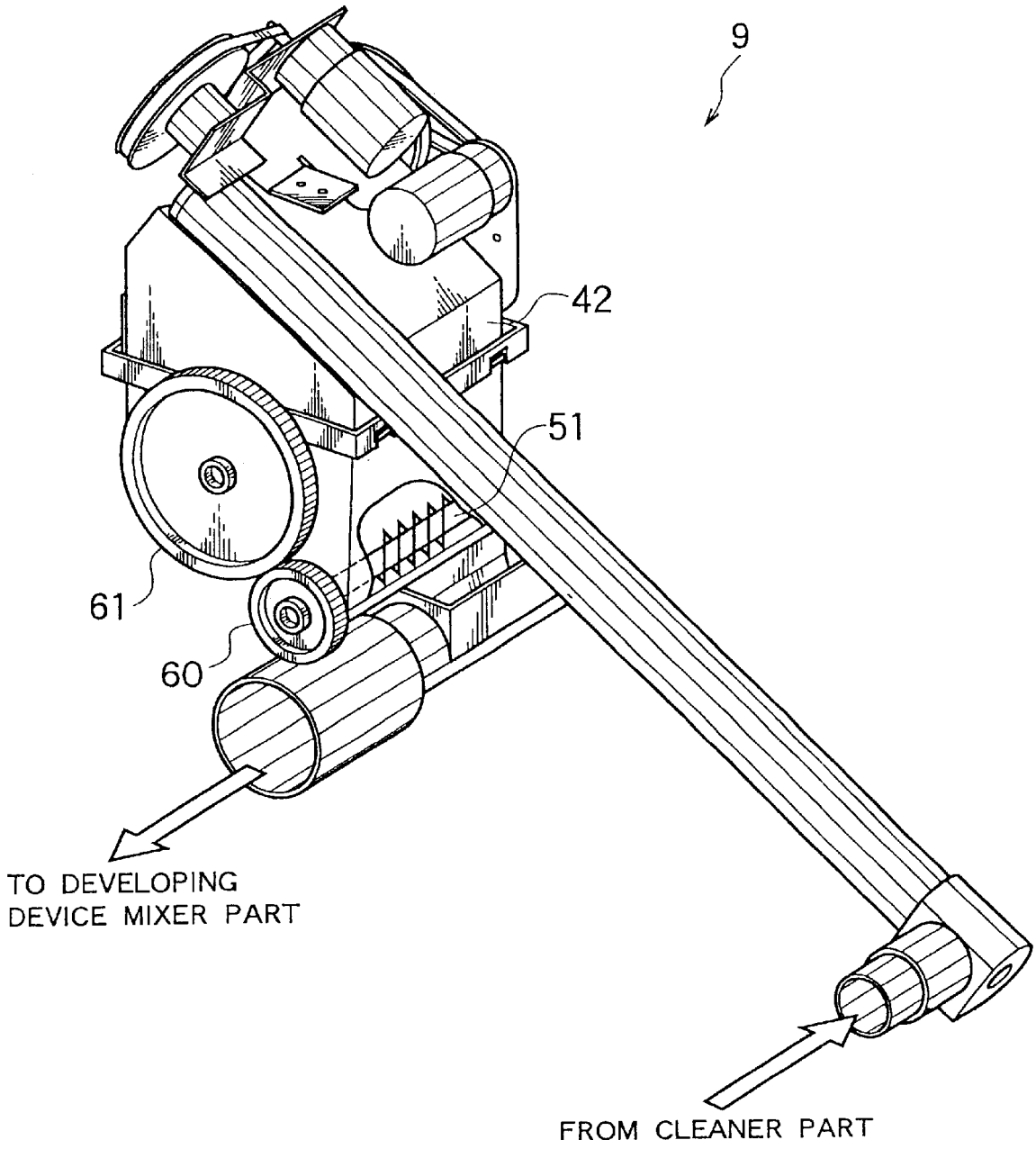
FIG. 6 is a perspective view of the recovered toner supply device in the preferred embodiment, which is viewed from a view point different from that in FIG. 5.

Referring now to FIGS. 1 through 3, the whole construction of this image forming apparatus will be described below.

The image forming apparatus 1 mainly comprises a photosensitive drum 2, a de-electrifying part 3, an electrifying charger 4, a developing device 5, a transfer part 6, a cleaner part 7, a new toner supply device 8 and a recovered toner conveying device 9.

The photosensitive drum 2 is a cylindrical drum which is designed to rotate in one direction (clockwise in FIG. 1, i.e., in a direction of arrow B). The charged state on the surface of the photosensitive drum 2 is capable of being optionally adjusted by laser beams. Thus, by suitably adjusting the charged state of an optional portion on the surface of the photosensitive drum 2, an image or the like serving as data to be transferred can be formed on the surface of the photosensitive drum 2 as a latent image.

The de-electrifying part 3 is provided for removing electrification on the surface of the photosensitive drum 2. The de-electrifying part 3 comprises a de-electrifying lamp 3A. By exposing the surface of the photosensitive drum 2 to the light of the de-electrifying lamp 3A, all of residual electric charges on the surface are removed to prepare for the next print.

The electrifying charger 4 is provided for charging the surface of the photosensitive drum 2. The surface of the photosensitive drum 2 negatively charged by the electrifying charger 4 is exposed to laser beams, which are emitted from a laser unit (not shown), to form a latent image. That is, the surface of the photosensitive drum 2 is exposed to laser beams on the basis of input information, such as an original image, so that the surface potential approaches zero in accordance with the concentration of the image or the like to form a latent image.

The developing device 5 is provided for causing an appropriate amount of toner to adhere to the surface of the charged photosensitive drum 2. Since a two-component developing system is herein adopted, the developing device 5 houses therein a carrier and a toner, the percentage of which is adjusted so as to be about 5% (% by weight) with respect to about 95% (% by weight) carrier. Specifically, the new toner supply device 8 and the recovered toner conveying device 9 are suitably controlled to adjust the percentages of the carrier and toner. The amount of the toner in the developing device 5 is always monitored by an auto toner sensor 11. If the percentage of the toner in the developing device 5 is less than 5%, the new toner supply device 8 and the recovered toner conveying device 9 are suitably controlled by a control part 70, which will be described later, to supply a required amount of toner. The supplied toner and carrier are stirred by a mixer part SA in the developing device 5, so that negative charges are given to the toner by the frictional electrification during stirring. The negatively charged toner is absorbed onto the latent image on the surface of the photosensitive drum 2 to form a visible image.

The transfer part 6 is provided for transferring the toner, which is absorbed onto the latent image on the surface of the photosensitive drum 2, to a paper. The transfer part 6 mainly comprises a transfer belt 13 and a paper feeding part 14. The transfer belt 13 is designed to support thereon and convey a paper to cause the paper to contact the surface of the photosensitive drum 2 to transfer the visible image to the paper. The paper feeding part 14 is arranged so as to face a contact portion in which the transfer belt 13 contacts the photosensitive drum 2. The paper fed from the paper feeding part 14 to the contact portion in which the transfer belt 13 contacts the photosensitive drum 2 is positively charged to absorb the negatively charged toner which is used for forming the visible image. The paper to which the toner is transferred is fed to a fixing device (not shown) by which the toner is fixed to the paper.

The cleaner part 7 is provided for cleaning the surface of the photosensitive drum 2. The cleaner part 7 is designed to remove the toner remaining on the surface of the photosensitive drum 2 after the toner is transferred to the paper by the transfer part 6. The cleaner part 7 comprises a toner receiving part 15 and a discharging auger 16, in order to discharge the toner, which is removed from the surface of the photosensitive drum 2, to the outside. The toner removed from the surface of the photosensitive drum 2 falls to the toner receiving part 15 to be discharged toward the recovered toner conveying device 9 by means of the discharging auger 16.

The new toner supply device 8 is a device for supplying a new toner to the developing device 5. As shown in FIGS. 2 and 3, the new toner supply device 8 is arranged so as to extend in a direction perpendicular to the developing device 5. In this state, the new toner supply device 8 is installed on the front side of the body of the copying machine. The new toner supply device 8 comprises a toner housing container part 18, two stirring/conveying paddles 19, a toner residual amount detecting sensor 20 and a conveying part 21.

The toner housing container part (new toner hopper) 18 is a container for storing therein a new toner. The toner housing container part 18 comprises a substantially semi-cylindrical container, the upper side of which is open. The semi-cylindrical toner housing container part 18 is divided into a shallow-bottom portion 18A and a deep-bottom portion 18B at the center thereof in longitudinal directions. In the shallow-bottom portion 18A, the two stirring/conveying paddles 19 are provided so as to extend in parallel to each other. The deep-bottom portion 18B is provided with the toner residual amount detecting sensor 20 and the conveying part 21.

The stirring/conveying paddles 19 constitutes a device for conveying the new toner, which is stored in the toner housing container part 18, to the conveying part 21 while stirring the new toner. As described above, the stirring/conveying paddles 19 are provided in the shallow-bottom portion 18A of the toner housing container part 18 so as to extend in parallel to each other. If the two stirring/conveying paddles 19 rotate, the new toner in the toner housing container part 18 is transferred to the conveying part 21 of the deep-bottom portion 18B. Each of the stirring/conveying paddles 19 is driven by a drive unit (not shown).

The toner residual amount detecting sensor 20 is a sensor for detecting the residual amount of the new toner which is stored in the toner housing container part 18. The residual amount of the new toner is always detected by the toner residual amount detecting sensor 20, since it is not possible to carry out image formation if the toner is completely consumed. As the toner residual amount detecting sensor 20, a well-known sensor, such as a magnetic sensor or an optical sensor, may be used.

The conveying part 21 is provided for supplying the new toner, which is stored in the toner housing container part 18, to the developing device 5. The conveying part 21 comprises a toner conveying auger 23 and an auger driving part 24. The toner conveying auger 23 is a screw conveyer which is provided on the bottom of the deep-bottom portion 18B so as to extend in parallel to the toner housing container part 18. The toner conveying auger 23 is arranged so as to face a toner pan part 64 which will be described later, and is designed to supply the new toner which is stored in the toner housing container part 18. The auger driving part 24 comprises a drive motor (which will be hereinafter referred to as a "toner hopper motor") 26, and a reduction gear 27. The toner hopper motor 26 comprises, e.g., a stepping motor. By controlling the rotating amount and rotating time of the toner conveying auger 23 by the toner hopper motor 26, the amount of the new toner to be supplied is precisely controlled. The reduction gear 27 comprises a belt 28, a pulley 29 and gears 30 through 36. The gears 30 through 36 are suitably adjusted in accordance with reduction ratios. On the rotation shaft of the gear 32, a stirring rod (not shown) provided on the deep-bottom portion 18B is mounted.

The recovered toner conveying device 9 is provided for conveying the recovered toner, which is recovered by the cleaner part 7, to the developing device 5 to recycle the recovered toner therein. The recovered toner conveying device 9 is arranged below the new toner supply device 8 so as to substantially extend in parallel thereto. As shown in FIGS. 3 through 6, the recovered toner conveying device 9 comprises a recovered toner connecting/conveying auger 41, a recovered toner sub-hopper 42 and a supply auger 43.

The recovered toner connecting/conveying auger 41 is provided for conveying the recovered toner, which is recovered by the cleaner part 7, toward the developing device 5. The recovered toner connecting/conveying auger 41 comprises, e.g., a long screw conveyer. The bottom end portion of the recovered toner connecting/conveying auger 41 is connected to the discharging auger 16 of the cleaner part 7, and the top end portion thereof is connected to the recovered toner sub-hopper 42. The driving part 45 of the recovered toner connecting/conveying auger 41 comprises a drive motor 47 which is provided adjacent to the top end portion of the recovered toner connecting/conveying auger 41, a pulley 48 which is connected to the recovered toner connecting/conveying auger 41, and a belt 49 which connects the drive motor 47 to the pulley 48. The drive motor 47 is controlled so as to be connected with the drive motor of the discharging auger 16.

The recovered toner sub-hopper 42 is a container for temporarily storing the recovered toner, which is recovered by the recovered toner connecting/conveying auger 41, to feed the required amount of the recovered toner to the developing device 5. In the recovered toner sub-hopper 42, there is provided a stirring rod (not shown) for stirring the recovered toner which is stored therein. In the lower portion in the recovered toner sub-hopper 42, a recovered toner supply auger 51 is provided. The rotation of the recovered toner supply auger 51 is controlled by a driving part 52, so that the recovered toner supply auger 51 is designed to supply a precise amount of recovered toner to the supply auger 43. The driving part 52 comprises a drive motor 53 and a reduction gear 54. The drive motor 53 comprises, e.g., a stepping motor. The reduction gear 54 comprises a belt 55, a pulley 56 and gears 57 through 61 which are combined with each other. The gears 59 and 60 are provided on both sides of the recovered toner sub-hopper 42 to be connected to each other by means of a single rotation shaft which is provided with a stirring rod (not shown).

The supply auger 43 is provided for receiving the recovered toner and the new toner from the recovered toner supply auger 51 and the toner conveying auger 23 of the new toner supply device 8, respectively, to supply them into the developing device 5. The supply auger 43 comprises an auger part 63 which is provided so as to extend from the mixer part 5A of the developing device 5, and a toner pan part 64 which is open to the recovered toner supply auger 51 and the toner conveying auger 23. The drive motor (not shown) of the auger part 63 is provided on the side of the developing device 5. The recovered toner supply auger 51 is provided on the side of the developing device 5. In the toner pan part 64, the new toner from the toner conveying auger 23 of the new toner supply device 8 is supplied to upstream of the recovered toner from the recovered toner supply auger 51.

Figure 7:
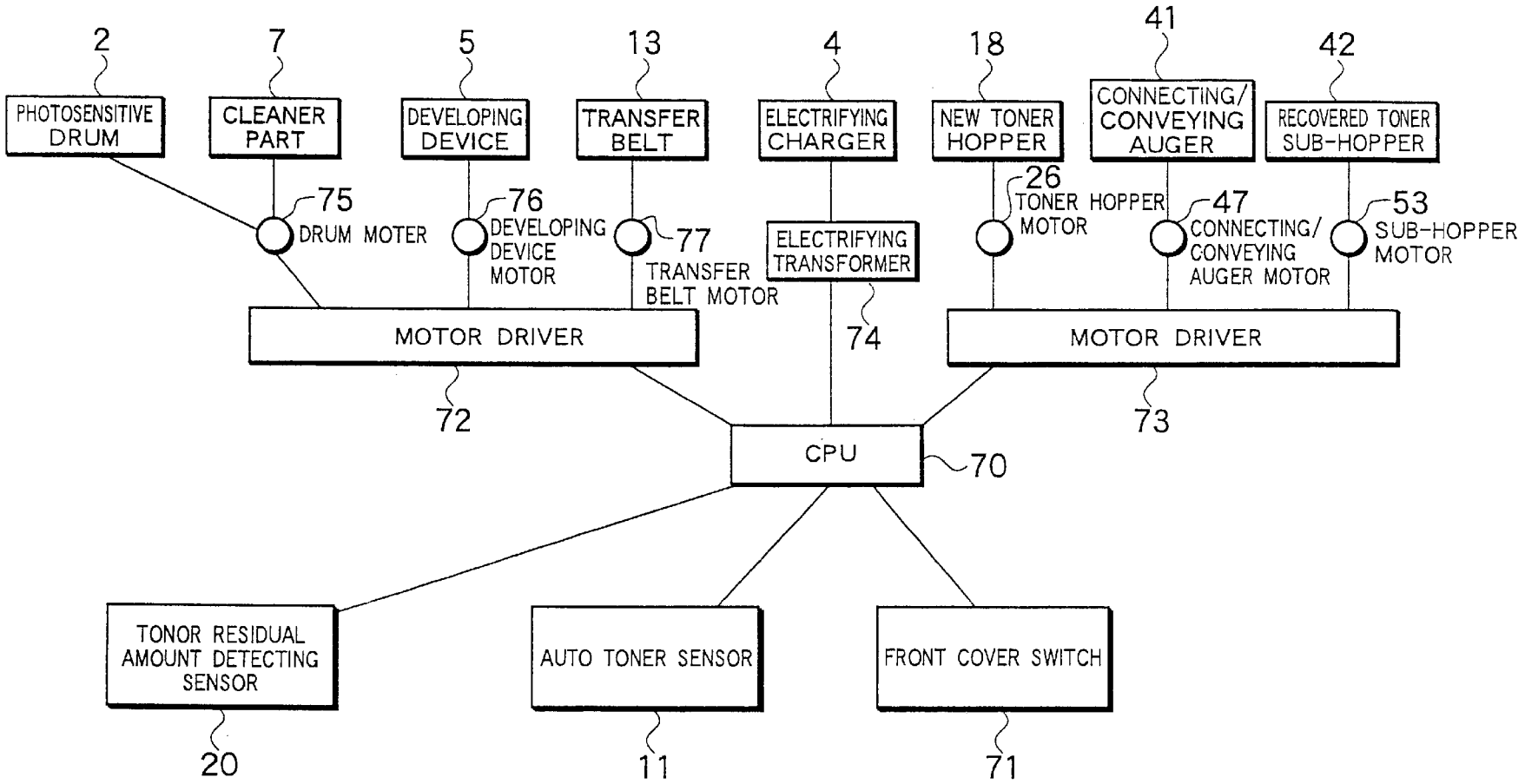
FIG. 7 is a block diagram showing the control construction of the image forming apparatus in the preferred embodiment.

FIG. 7 is a block diagram showing the control construction of the image forming apparatus 1 in this preferred embodiment.

A control part (shown by CPU in FIG. 7) 70 comprises, e.g., a CPU, ROM and RAM, and is designed to control the whole image forming apparatus 1 on the basis of a processing program, which is stored in the ROM and RAM, and in accordance with data and the outputs of various sensors, which are stored in the ROM and RAM.

The input port of the control part 70 is connected to the above described toner residual amount detecting sensor 20 and auto toner sensor 11, and to a front cover switch 71.

As described above, the toner residual amount detecting sensor 20 is designed to detect the residual amount of the new toner in the new toner hopper 18. For example, as the toner residual amount detecting sensor 20, a magnetic sensor comprising a magnet and a reed switch may be used. When the residual amount of the new toner is large, the new toner enters between the magnet and the reed switch to form a gap therebetween to turn the reed switch off. On the other hand, when the residual amount of the new toner is small, the gap disappears, so that the reed switch is turned on by the attraction of the magnet. Such on/off of the reed switch is detected by the control part 70.

As described above, the auto toner sensor 11 is a toner concentration ratio sensor for detecting the ratio of the carrier (iron) to the toner (resin) in the developer. The output of the auto toner sensor 11 is read by the control part 70. If the concentration of the toner decreases, the control part 70 is designed to drive the toner hopper motor 26 and so forth to supply the toner to the developing device 5, and to display no toner on a control panel (not shown) to inform the user of it.

The front cover switch 71 is a switch which is turned off/on by the opening/closing of a body cover (which is herein assumed as a front cover) of the copying machine. The control part 70 reads the output signal of the front cover switch 71 to recognize the state of the front cover.

The output port of the control part 70 is connected to two motor drivers 72, 73 and an electrifying transformer 74.

The photosensitive drum 2 and the cleaner part 7 are driven by a drum motor 75, which is rotated by a motor driver 72, under the control of the control part 70 during a copying operation or the like.

Similarly, the developing device 5 and the transfer belt 13 are driven by a developing motor 76 and a transfer belt motor 77, respectively, which are rotated by the motor driver 72, under the control of the control part 70 during a copying operation or the like.

Similarly, the new toner hopper 18, the connecting/conveying auger 41 and the recovered toner sub-hopper 42 are driven by the toner hopper motor 26, the connecting/ conveying auger motor 47 and the sub-hopper motor 53, respectively, which are rotated by the motor driver 73.

Furthermore, although the toner hopper motor 26, the connecting/conveying auger motor 47 and the sub-hopper motor 53 are connected to the same motor driver 73, these motors can be separately driven by the control of the control part 70.

As described above, during a copying operation or the like, a high voltage is applied to the electrifying charger 4 by the electrifying transformer 74 under the control of the control part 70, so that the electrifying charger 4 electrifies the photosensitive drum 2.

Referring to the flow chart of FIG. 8, the schematic image forming operation (image forming method) in the image forming apparatus in this preferred embodiment will be described below.

Figure 8:
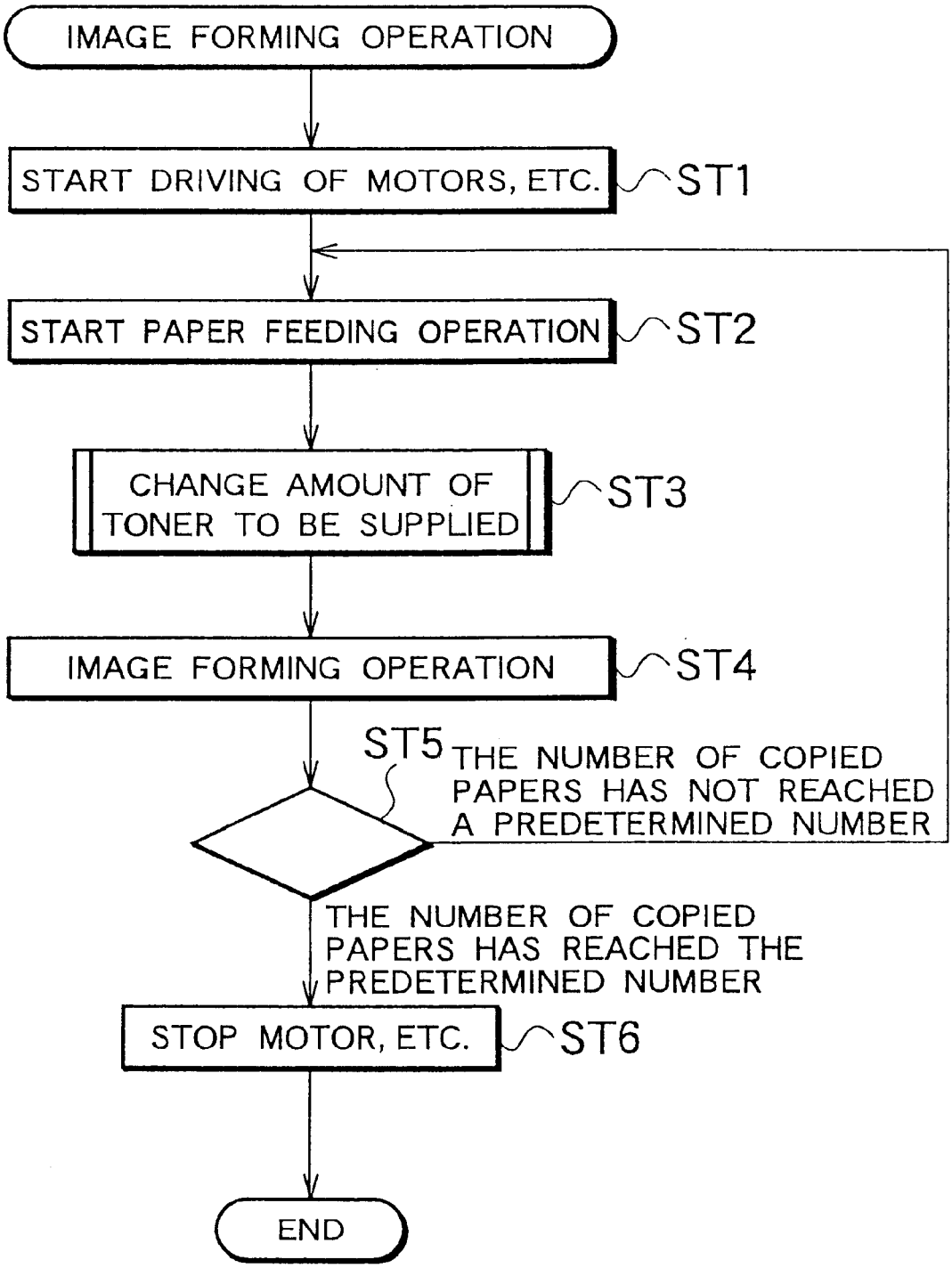
FIG. 8 is a flow chart showing an image forming operation in the preferred embodiment of an image forming apparatus according to the present invention.

In FIG. 8, if a copying operation (image forming operation) is started by a keying part (not shown), the control part 70 carries out a drive starting process for various motors (ST1).

Figure 9:
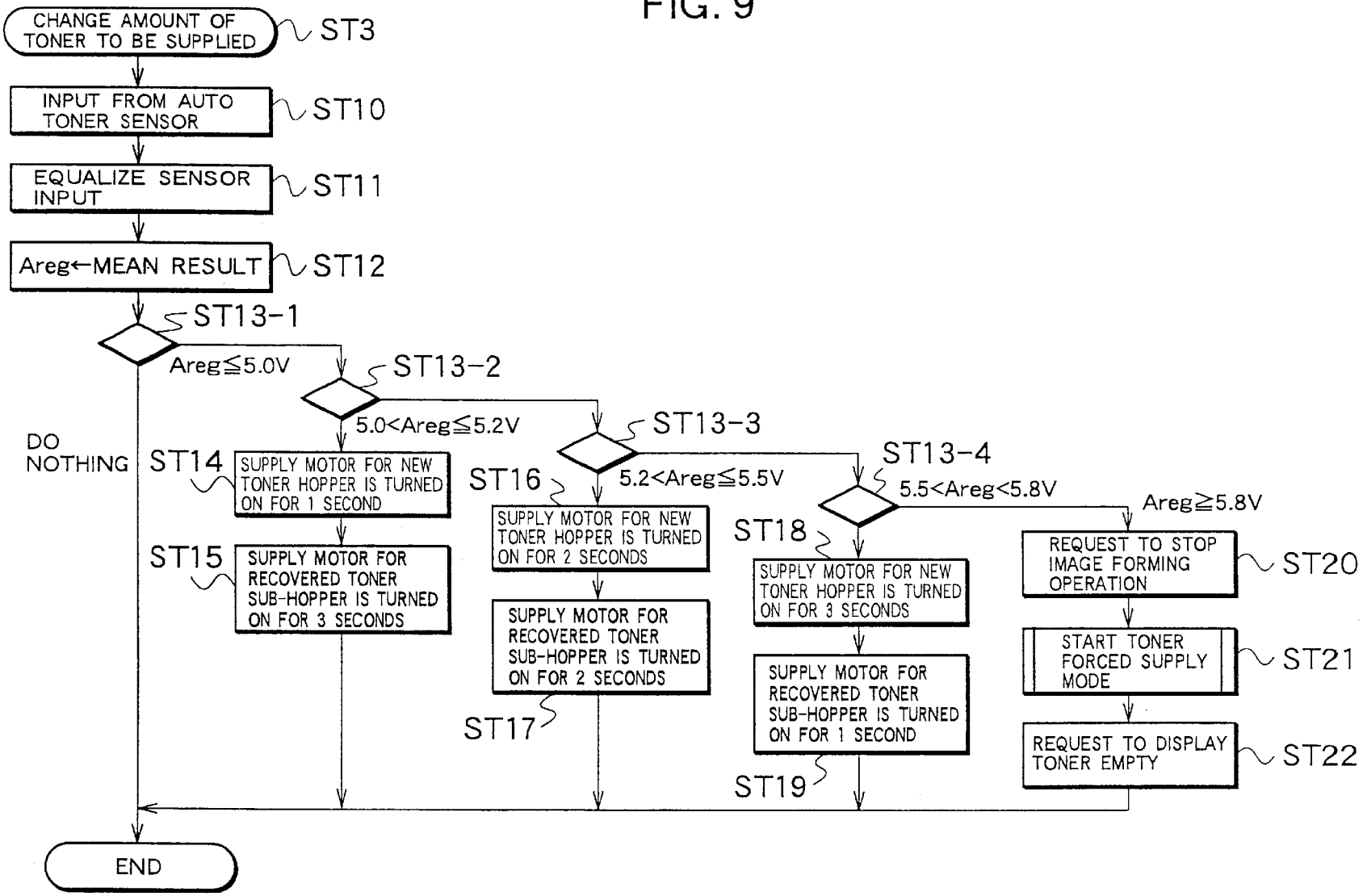
FIG. 9 is a flow chart showing a toner supply amount changing control process in FIG. 8.

Thereafter, a process for each paper is carried out. That is, the control part 70 causes to start a paper feeding operation (ST2), and carries out a toner supply amount changing control (ST3), the details of which are shown in FIG. 9. Then, the control part 70 causes to execute a concrete image forming operation (ST4).

After such a process for each paper is completed, the control part 70 determines whether the number of copied papers reaches a predetermined number (ST5). If the number of copied papers has not reached the predetermined number, the routine returns to the above described step ST2. On the other hand, if the number of copied papers has reached the predetermined number, the control part 70 causes to execute a stopping process for various motors (ST6).

Referring to the flow chart of FIG. 9, the details of the toner supply amount changing control process at the above described step ST3 will be described below.

The new toner has been stored in the new toner hopper 18, and the recovered toner recovered by a cleaner auger part (not shown) has been conveyed by the connecting/conveying auger 41 to be stored in the recovered toner sub-hopper 42.

The toner supply control to the developing device 5 is basically carried out when the toner specific concentration to the developer, which is detected by the auto toner sensor (toner concentration ratio sensor) 11 provided in relation to the developing 5, is less than a reference concentration.

In the toner supply amount changing control process shown in FIG. 9, the control part 70 first inputs an output voltage from the auto toner sensor 11 (ST10), to equalize the inputted voltage in order to remove the influence of noises and so forth (ST11), and sets the mean result as a toner concentration ratio parameter Areg (ST12).

Furthermore, in the following descriptions, it is assumed that the output voltage of the auto toner sensor 11 increases as the toner concentration ratio decreases. It is also assumed that the new toner hopper 18 and the recovered toner sub-hopper 42 have the same supply capacity when being driven for the same period of time, as will be described later.

If the control part 70 obtains the toner concentration ratio parameter Areg, the control part 70 determines its stage (ST13-1 through ST13-4).

When the toner concentration ratio parameter Areg is 5.0 V or less, i.e., when the toner concentration in the developer is a reference concentration or higher, the control part 70 ends the process shown in FIG. 9 without causing to supply toner from the new toner hopper 18 and recovered toner sub-hopper 42. That is, both of the new toner and the recovered toner are not supplied to the developing device 5.

When the toner concentration ratio parameter Areg is higher than 5.0 V and lower than or equal to 5.2 V, i.e., when the toner concentration in the developer is slightly lower than the reference concentration, the control part 70 causes the toner hopper motor 26, which causes to supply the new toner in the new toner hopper 18 to the developing device 5, to be turned on only for 1 second to supply the new toner to the developing device 5 (ST14), and causes the sub-hopper motor 53, which causes to supply the recovered toner in the recovered toner sub-hopper 42 to the developing device 5, to be turned on only for 3 seconds to supply the recovered toner to the developing device 5 (ST15).

When the toner concentration ratio parameter Areg is higher than 5.2 V and lower than or equal to 5.5 V, i.e., when the toner concentration in the developer is intermediately lower than the reference concentration, the control part 70 causes the toner hopper motor 26, which causes to supply the new toner in the new toner hopper 18 to the developing device 5, to be turned on only for 2 seconds to supply the new toner to the developing device 5 (ST16), and causes the sub-hopper motor 53, which causes to supply the recovered toner in the recovered toner sub-hopper 42 to the developing device 5, to be turned on only for 2 seconds to supply the recovered toner to the developing device 5 (ST17).

When the toner concentration ratio parameter Areg is higher than 5.5 V and lower than 5.8 V, i.e., when the toner concentration in the developer is much lower than the reference concentration, the control part 70 causes the toner hopper motor 26, which causes to supply the new toner in the new toner hopper 18 to the developing device 5, to be turned on only for 3 seconds to supply the new toner to the developing device 5 (ST18), and causes the sub-hopper motor 53, which causes to supply the recovered toner in the recovered toner sub-hopper 42 to the developing device 5, to be turned on only for 1 second to supply the recovered toner to the developing device 5 (ST19).

When the toner concentration ratio parameter Areg is 5.8 V or more, i.e., when the toner concentration in the developer is such a concentration that the toner can not be utilized for image formation, the control part 70 issues a request to stop the image forming operation to the respective parts (ST20), starts a process in a mode in which the new toner is forced to be supplied (ST21), and requests a display part (not shown) to display a toner empty (ST22).

Figure 10:
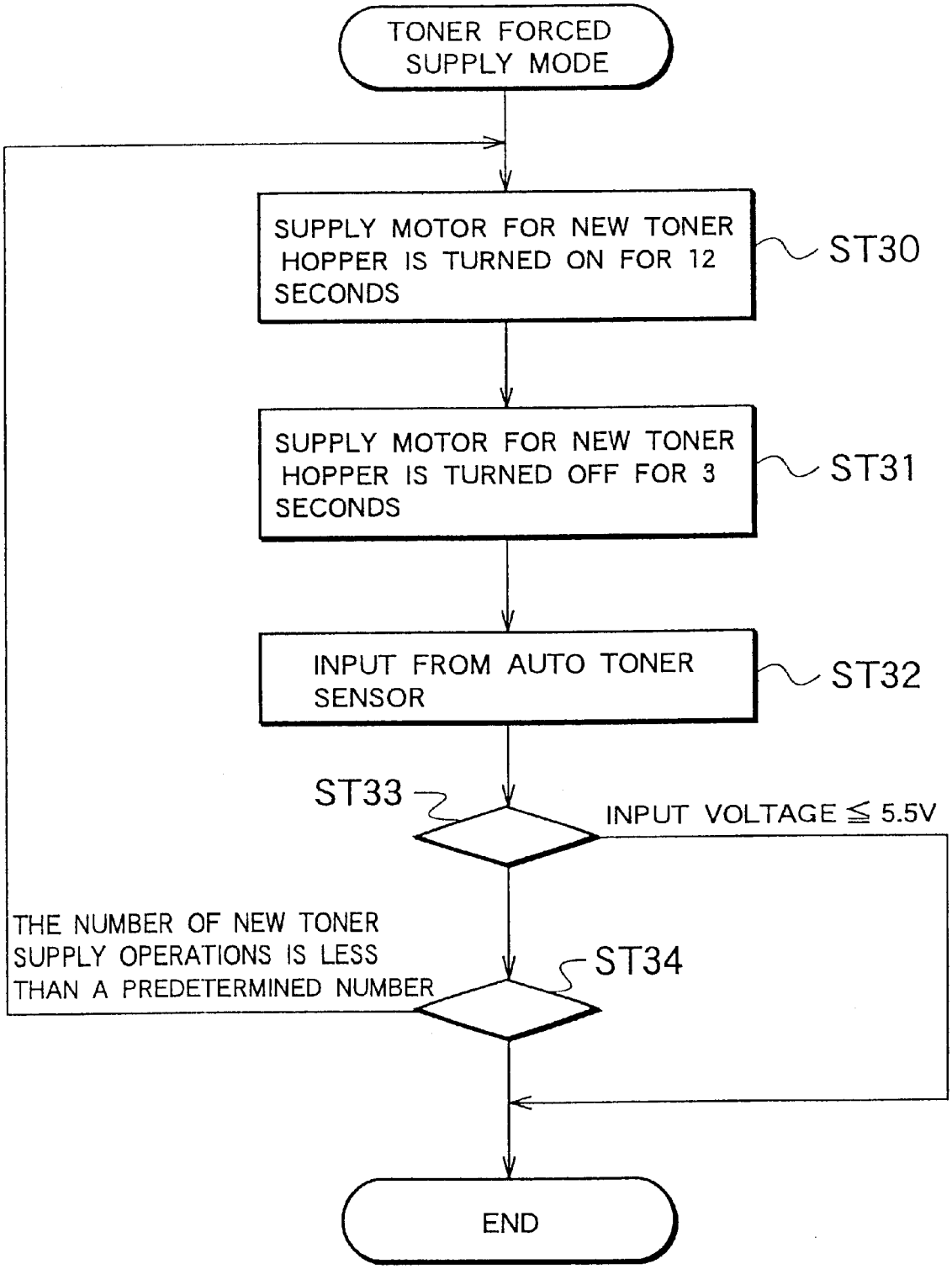
FIG. 10 is a flow chart showing a supply control process in a toner forced supply mode.

FIG. 10 is a flow chart showing the details of a process in a mode in which the new toner is forced to be supplied, which is started at step ST20.

In the process in the toner forced supply mode, the control part 70 first causes the toner hopper motor 26, which causes to supply the new toner in the new toner hopper 18 to the developing device 5, to be turned on only for 12 seconds (ST30), and then, causes the toner motor hopper 26 to be turned off only for 3 seconds (ST31). During this off period, a process for stirring the developer, in which carrier and toner have been mixed, is carried out in the developing device 5.

After the off period of 3 seconds, the control part 70 receives a voltage signal indicative of a toner concentration ratio from the auto toner sensor 11 (ST32), and determines whether the toner concentration ratio is higher than a reference concentration (input voltage $\leqq$5.5 V) (ST33).

If the toner concentration ratio is the reference concentration or less, the control part 70 determines whether the number of new toner supply operations is less than a predetermined number (ST34). If it is less than the predetermined number, the control part 70 causes the routine to return to the above described step S30.

If the toner concentration ratio is higher than the reference concentration, or if the number of new toner supply operations reaches the predetermined number although the toner concentration ratio is the reference concentration or less, the control part 70 ends the process in the toner forced supply mode.

As described above, in this preferred embodiment unlike the prior art, the toner supplied to the developing device 5 in the toner forced supply mode is only the new toner. Furthermore, both of the new toner and the recovered toner may be supplied similar to the prior art. In that case, the ratio of the recovered toner to the new toner to be supplied is decreased to be lower than the ratio of the recovered toner to the new toner in the developer.

The reasons why the toner supply amount changing control process is carried out as shown in FIGS. 9 and 10 will be described below.

As the number of copying operations increases, the amount of consumed toner increases. Therefore, in general, the toner concentration in the developer decreases, and the toner concentration ratio parameter Areg gradually increases. That is, if the new toner in the new toner hopper 18 is completely consumed to decrease the amount of toner to be supplied to the developing device 5, the developer toner specific concentration in the developing device 5 is gradually decreased by the image forming operation, so that the output voltage of the auto toner sensor 11 gradually increases from the reference voltage of 5.0 V. Then, when the toner specific concentration is lower than the reference concentration by about 1% by weight, the output voltage of the auto toner sensor 11 is 5.8 V. This is regarded as the empty state of the new toner. Then, as described above, the process in the toner forced supply mode is carried out, and the toner empty is displayed so that the user can recognize it. Simultaneously, the image forming operation is stopped.

Even before the stage regarded as the empty state of the new toner as described above, the times required to drive the new toner and recovered toner supplying hoppers 18 and 42 are controlled in accordance with the toner concentration ratio to carry out an operation for causing the toner concentration ratio to return to the reference concentration.

Conventionally, the ratio of the driving time required to supply toner from the new toner hopper 16 to that from the recovered toner sub-hopper 42 is constant in any toner concentration ratio stage, whereas, in this preferred embodiment, the driving time is changed. The fact that the toner concentration ratio is vary small means that the toner concentration ratio until that time was small, so that the amount of toner housed in the new toner hopper 18 is often small. For that reason, the amount of the recovered toner to be supplied is increased.

This is based on the fact that the control part 70 can separately control the amount of toner supplied from the new toner hopper 18 and the amount of toner supplied from the recovered toner sub-hopper 42.

When the developer toner concentration in the developing device 5 decreases to the reference value or less due to the fact that the amount of toner supplied from each of the toner hoppers 18 and 42 is not enough, e.g., when image formation is carried out at a high printing rate, or after the new toner is supplied from a cartridge to the new toner hopper after the toner empty, a toner supply control in a toner forced supply mode is carried out similar to the prior art.

In the toner forced supply mode, the developer toner specific concentration in the developing device 5 can be returned to the reference value in a short time. However, since a larger amount of toner than that in usual cases is supplied in the short time, there are some cases where the quantity of electrification does not reach the normal quantity of electrification even if the supplied toner is stirred in the developing device 5. If the toner reaches a developing sleeve to carry out development while the toner has such a low quantity of electrification, a phenomenon called image fogging occurs.

This phenomenon is easier to occur when the toner forced to be supplied is the recovered toner, from which the external additive has been peeled, than the new toner.

Figure 11:
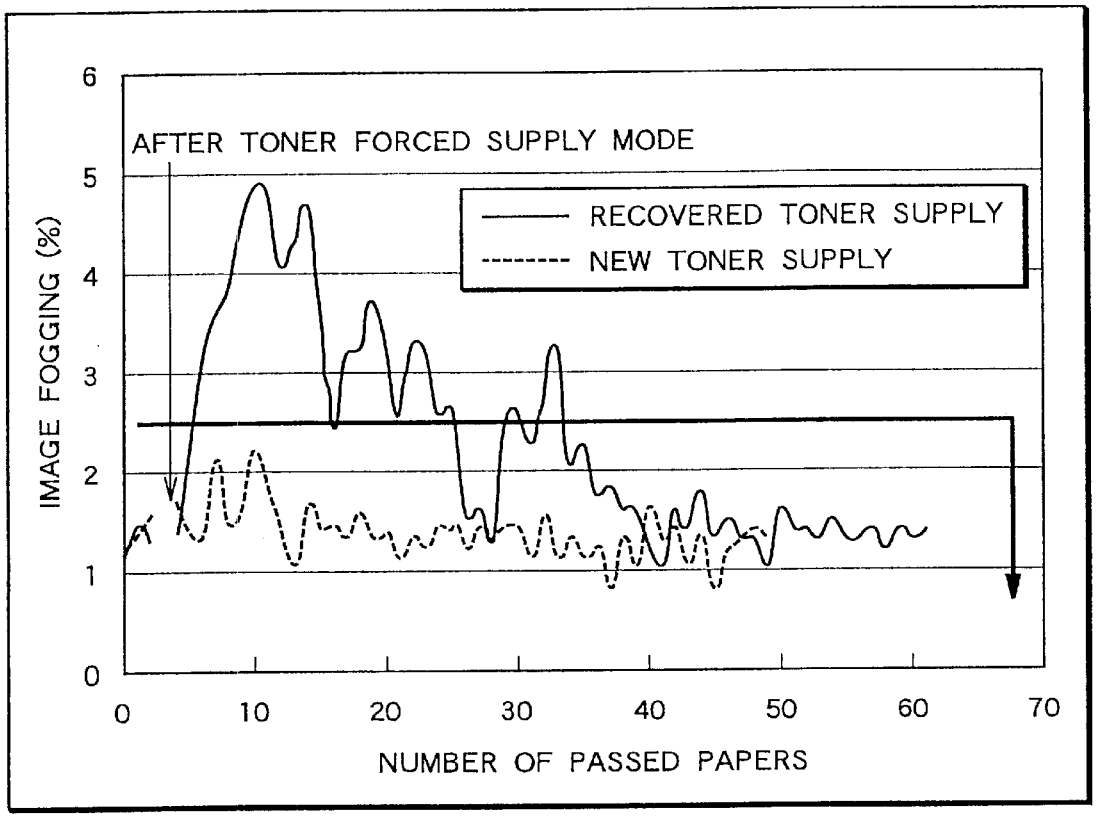
FIG. 11 is a graph showing the variations in image fogging after a process in a toner forced supply mode in which only a new toner is supplied, and after a process in a toner forced supply mode in which only a recovered toner is supplied.

FIG. 11 shows the rates of occurrence of image fogging after a process in a toner forced supply mode in which only a new toner is forced to be supplied (broken line) and after a process in a toner forced supply mode in which only a recovered toner is forced to be supplied (solid line).

From FIG. 11, it can be seen that, in the case of the new toner, image fogging scarcely occurs due to the appropriate amount of external additive even after the toner force supply mode. On the other hand, it can be seen that, in the case of the recovered toner, image fogging considerably occurs after the toner forced supply since the recovered toner is not electrified to carry out development, and that the image fogging is returning to usual image fogging by the continuous stirring.

For that reason, as described above, in this preferred embodiment, in the toner forced supply mode, only the new toner is supplied, and the recovered toner is not supplied. Thus, as can be clearly seen from FIG. 11, it is possible to obtain an image having no image fogging even after the toner forced supply mode.

Furthermore, in the toner forced supply mode, a smaller percentage of recovered toner than that in a usual supply operation may be supplied without completely stopping the supply of the recovered toner. For example, when the output of the auto toner sensor 11 indicates that the toner concentration ratio is vary small, the ratio of the supply time from the new toner hopper 18 to the supply time from the recovered toner sub-hopper 42 is 3:1 in this preferred embodiment (see steps ST18 and ST19 in FIG. 9). However, the ratio of the recovered toner supplying time may be smaller than the above described ratio to supply the recovered toner.

In accordance with the rise performance of electrification of toner determined by the kinds of toner and developer, the image fogging can be decreased to such an extent that there is no problem even if a little recovered toner is supplied in the toner forced supply mode. In addition, the supply of the recovered toner can be carried out, so that it can be expected to decrease the capacity of the recovered toner sub-hopper 42.

As described above, according to the above described preferred embodiment, the supply time from the new toner hopper 18 and the supply time from the recovered toner sub-hopper 42 can be separately controlled. Therefore, the combination of the supply time from the new toner hopper 18 and the supply time from the recovered toner sub-hopper 42 can be changed in accordance with the toner specific concentration indicated by the output of the auto toner sensor 11, so that it is possible to appropriately control the supply of toner in accordance with the residual amount of toner in the new toner hopper 18.

According to this preferred embodiment, in the toner forced supply mode, the recovered toner is not supplied, or the ratio of the amount of the recovered toner to be supplied to the amount of the new toner to be supplied is decreased so as to be less than that during a usual operation. Therefore, it is possible to carry out good image formation wherein image fogging causes no problem after the toner forced supply mode.

In the above described preferred embodiment, the toner supply control is carried out regardless of the size of papers used for image formation. However, the combination of the times required to supply the new toner and the recovered toner may be changed in accordance with the size of papers used for image formation.

In the above described preferred embodiment, in the toner forced supply mode, only the new toner is supplied (see step ST30 in FIG. 10) regardless of the number of supply operations (the number of loops at steps ST30 through ST34 in FIG. 10). However, the recovered toner may be also supplied as the number of supply operations increases.

In the above described preferred embodiment, the new toner supply construction is not a cartridge construction. However, the present invention can be applied to a case where the new toner supply construction is a cartridge construction.

The image forming apparatus and method according to the present invention can not only be applied to copying machines, but they can be also applied to other apparatuses, such as printers and facsimiles, which use a photosensitive drum for carrying out image formation.

What is claimed is:

1. An image forming apparatus comprising:

recovered toner housing means for temporarily storing therein a recovered toner;

a connecting/conveying device for conveying said recovered toner from a cleaner part to said recovered toner housing means;

recovered toner supply means for supplying said recovered toner, which is housed in said recovered toner housing means, to a developing device;

new toner housing means for housing therein a new toner;

new toner supply means for supplying said new toner, which is stored in said new toner housing means, to said developing device;

toner concentration ratio detecting means for detecting a toner concentration ratio in said developing device; and control means for separately controlling said recovered toner supply means and said new toner supply means in accordance with the contents detected by said toner concentration ratio detecting means, to cause to change the combination of the amounts of said recovered toner and new toner to be supplied to said developing device, wherein said control means causes only said new toner supply means to carry out the supply of toner for first predetermined period in an operation mode in which toner is forced to be supplied to said developing device and subsequently to stop the supply of toner for second predetermined period, and wherein said control means determines whether or not the contents detected by said toner concentration ratio detecting means indicates that the toner concentration ratio is lower than a threshold for ending the forced supply, and if the toner concentration ratio is lower than the threshold, said controls means allows to carry out said supply for first predetermined period and said stop of the supply for second predetermined period repeatedly up to a predetermined number.

2. An image forming apparatus as set forth in claim 1, wherein said control means starts the operation mode, in which toner is forced to be supplied to said developing device, when the contents detected by said toner concentration ratio detecting means indicate a toner concentration ratio at which image formation is not capable of being carried out.

3. An image forming method for causing a connecting/conveying device to convey a recovered toner from a cleaner part to recovered toner housing means to house therein said recovered toner, and causing control means to control recovered toner supply means and new toner supply means in accordance with a toner concentration ratio in a developing device, which is detected by toner concentration ratio detecting means, to supply said recovered toner, which is stored in said recovered toner housing means, and a new toner, which is stored in new toner housing means, to said developing device, wherein said control means separately controls said recovered toner supply means and said new toner supply means in accordance with the contents detected by said toner concentration ratio detecting means, to cause to change the combination of the amounts of said recovered toner and new toner to be supplied to said developing device, and wherein said control means causes only said new toner supply means to carry out the supply of toner for first predetermined period in an operation mode in which toner is forced to be supplied to said developing device and subsequently to stop the supply of toner for second predetermined period, and wherein said control means determines whether or not the contents detected by said toner concentration ratio detecting means indicates that the toner concentration ratio is lower than a threshold for ending the forced supply, and if the toner concentration ratio is lower than the threshold, said control means allows to carry out said supply for first predetermined period and said stop of the supply for second predetermined period repeatedly up to a predetermined number.

4. An image forming method as set forth in claim 3, wherein said control means starts the operation mode, in which toner is forced to be supplied to said developing device, when the contents detected by said toner concentration ratio detecting means indicate a toner concentration ratio at which image formation is not capable of being carried out.

* * * * *